US006157346A

United States Patent [19]

Ho

[11] Patent Number: 6,157,346

[45] Date of Patent: Dec. 5, 2000

[54] HEXAFILAR SLOT ANTENNA

[75] Inventor: Chien H. Ho, San Diego, Calif.

[73] Assignee: Garmin Corporation, Taiwan

[21] Appl. No.: 09/263,175

[22] Filed: Mar. 5, 1999

Related U.S. Application Data

[63] Continuation-in-part of application No. 08/642,506, May 3, 1996, Pat. No. 5,955,997.

[51] Int. Cl.[7] ..... H01Q 13/10; H01Q 1/36

[52] U.S. Cl. ..... 343/770; 343/767; 343/895

[58] Field of Search ..... 343/767, 770, 343/768, 895, 700 MS; H01Q 1/36, 13/10

[56] References Cited

U.S. PATENT DOCUMENTS

| | | | |
|---|---|---|---|
| D. 363,488 | 10/1995 | Shumaker | D14/230 |
| 2,665,381 | 1/1954 | Smith et al. | 250/33 |
| 2,877,427 | 3/1959 | Butler | 333/9 |
| 4,012,744 | 3/1977 | Greiser | 343/895 |
| 4,203,070 | 5/1980 | Bowles et al. | 375/1 |
| 4,297,707 | 10/1981 | Brunner et al. | 343/725 |
| 4,451,830 | 5/1984 | Lucas et al. | 343/768 |
| 4,612,543 | 9/1986 | DeVries | 343/5 |
| 4,675,691 | 6/1987 | Moore | 343/908 |
| 4,763,130 | 8/1988 | Weinstein | 343/770 |
| 4,843,403 | 6/1989 | Lalezari et al. | 343/767 |
| 5,068,670 | 11/1991 | Maoz | 343/767 |
| 5,200,757 | 4/1993 | Jairam | 343/786 |
| 5,216,430 | 6/1993 | Rahm et al. | 343/700 |
| 5,255,005 | 10/1993 | Terret et al. | 343/895 |
| 5,353,040 | 10/1994 | Yamada et al. | 343/895 |
| 5,427,032 | 6/1995 | Hiltz et al. | 102/336 |
| 5,955,997 | 9/1999 | Ho et al. | 343/767 |

*Primary Examiner*—Tan Ho
*Assistant Examiner*—Hoang Nguyen
*Attorney, Agent, or Firm*—Shook, Hardy & Bacon L.L.P.

[57] ABSTRACT

A hexafilar slot antenna for GPS receivers. The antenna has a cylindrical dielectric body covered with a conductive coating. Six helical slots are formed in the antenna and extend around one half of its circumference to provide a right hand circular polarization for receiving GPS signals. A microstrip feed system is provided and is arranged to create balanced currents along both sides of each slot so that the impedance transformation is not adversely affected.

19 Claims, 2 Drawing Sheets

HEXAFILAR SLOT ANTENNA

CROSS REFERENCE TO RELATED APPLICATION

This application is a continuation in part of U.S. application Ser. No. 08/642,506, filed May 3, 1996, now U.S. Pat. No. 5,955,997.

FIELD OF THE INVENTION

This invention relates generally to antennas used for the receipt of GPS signals and more specifically to a hexafilar slot antenna that has particular application in low profile installations on aircraft.

BACKGROUND OF THE INVENTION

In recent years, the Global Positioning System (GPS) has provided a significant advancement in satellite communications. Aircraft of various types are major users of the GPS system, and high speed aircraft have unique antenna requirements. The equipment that is required on the aircraft in order to efficiently utilize the GPS signals includes an antenna that must provide a right hand circular polarization and a uniform pattern coverage over virtually all of the upper hemisphere. By providing a uniform amplitude response over a wide coverage region, the receiver is able to maintain a signal lock to the GPS satellites with a useful signal to noise ratio.

High speed aircraft that maneuver extensively often abruptly change their look angles to the GPS satellite. Thus, a wide beam width coverage is necessary for the receiver to be able to track as many satellites as possible while still maintaining a proper Geometric Dilution of Precision (GTOP). Avoiding aerodynamic drag is an essential feature of most high speed aircraft, and it is equally important in many cases to provide an antenna that does not require significant structural modification of the aircraft. Slot antennas have been developed and used in GPS applications, largely in recognition of the characteristics that GPS antennas must exhibit when installed in high speed aircraft. Slot antennas are particularly desirable where low profile or flush installations are needed, as they are in high speed aircraft. A variety of slotted antennas have been proposed, including cylindrical slot antennas that are provided with helical slots. The prior antennas have included four slots and have generally been described as a quadrifilar slot antennas that have used micro strip feed systems. While this type of antenna has been found to be generally satisfactory in many applications, it is less than ideal in some respects, particularly in its horizon coverage and antimulti-path capabilities.

SUMMARY OF THE INVENTION

Accordingly, it is evident that a need exists for a GPS antenna that is improved in its ability to track satellites at low angles of elevation and in its resistance to multi-path signals. It is the principal goal of the present invention to meet that need.

More particularly, it is an object of the invention to provide an antenna that is improved in its operational capabilities while taking advantage of the practical benefits associated with slot antennas, such as suitability for low cost mass production and commercial applications, light weight, a compact configuration, broad beam pattern capabilities, and simplicity in feeding and matching techniques.

In accordance with the present invention, a resonant hexafilar structure is provided by forming six helical slots on a cylindrical antenna base in order to provide improvements over the quadrifilar antennas that have been used in the past, primarily with respect to improved tracking near the horizon and improved resistance to multi-path signals.

The body of the GPS antenna of the present invention is formed as a cylinder, preferably constructed from a dielectric laminate. The outer surface of the cylinder is coated with a conductive material that provides a ground for microstrip feed lines. Six helical slots are etched in the coating starting at one end of the cylinder and terminating well short of the opposite end. Each slot extends around approximately one-half of the circumference of the cylinder.

The microstrip feed lines are connected with an electric circuit and include transverse portions that cross the slots at right angles. Longitudinal portions of the feed lines extend from the transverse portions and are parallel to the slots. The ends of the feed lines terminate in open circuits. The longitudinal portions have lengths that are equal to about one fourth wavelength of the GPS signals. The resonant hexafilar structure provides the necessary right hand circular polarization and increases the radiation coverage in the horizontal plane.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
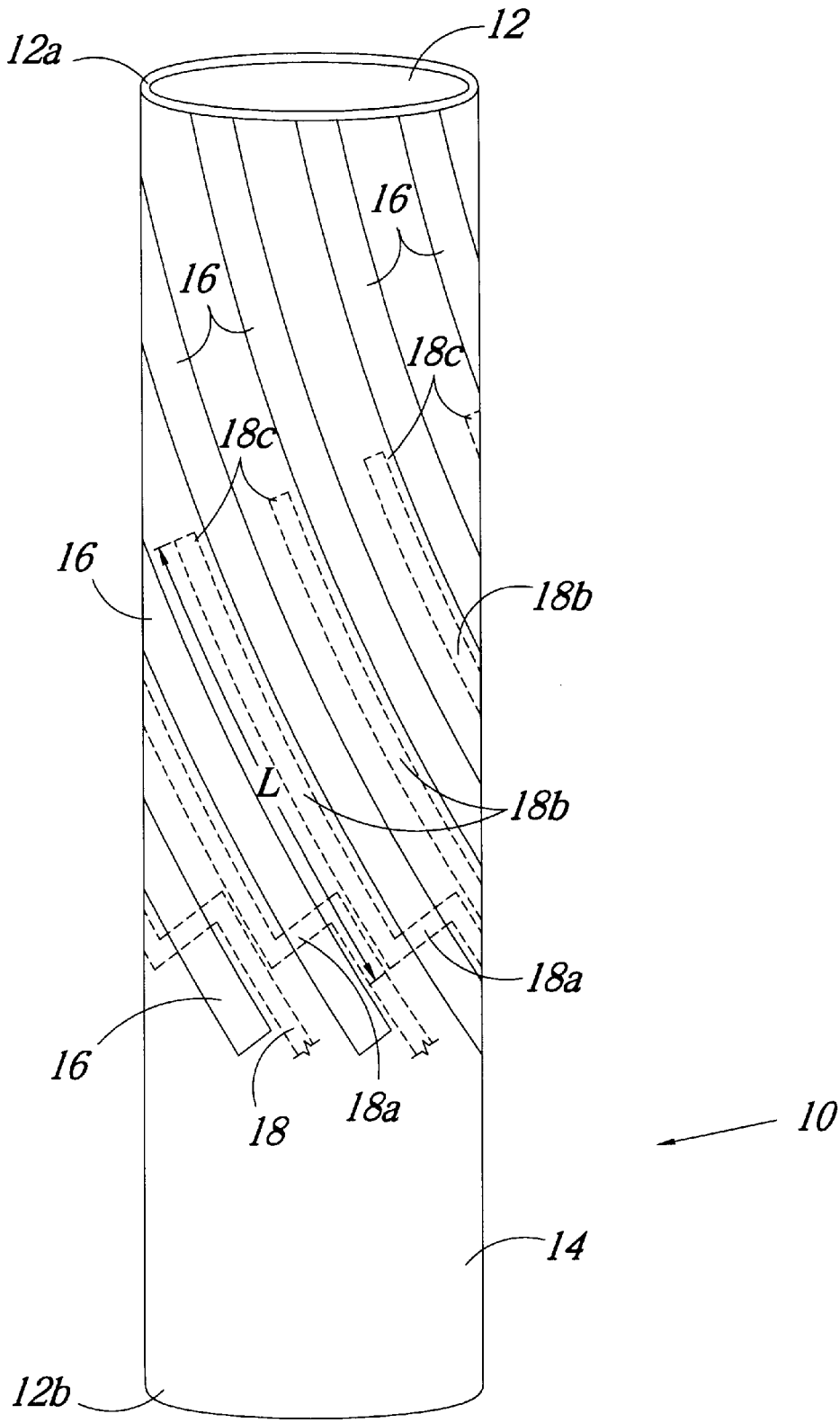
FIG. 1 is a perspective view of a hexafilar slot antenna constructed according to a preferred embodiment of the present invention, with the microstrip feed lines being shown only partially for purposes of clarity.

Referring now to the drawings in more detail and initially to FIG. 1, numeral 10 generally designates a printed quarter wavelength hexafilar slot antenna constructed in accordance with the present invention. The antenna 10 has a body which may be constructed of a dielectric laminate 12 having the shape of a hollow cylinder. The laminate 12 should be nonconductive and is preferably a dielectric constructed of KAPTON material (KAPTON is a registered trademark of E. I. DuPont Nemours & Co.). Other suitable materials can be used to construct the laminate 12 which forms the body portion of the antenna 10.

The cylindrical outer surface of the laminate 12 is provided with a thin coating 14 which coats the outside of the antenna 10. The coating 14 is constructed of a suitable electrically conductive material such as a metal. The coating 14 provides an electrical ground for microstrip feed lines which will subsequently be described.

The antenna 10 may have a cap (not shown) which includes a conductive material that is in contact with the coating 14 when the cap is in place on the top end 12*a* of the antenna body 12.

Six helical radiating slots 16 are formed through the antenna 10 and extend through the body 12 and the coating 14. The radiating slots 16 each has a spiral or helical configuration and extends into the top end of the antenna 10. Each slot 16 extends helically around approximately one-half of the circumference of the antenna 10 and terminates in a bottom end that is located well above the lower end 12*b* of the laminate 12 which provides the body of the antenna. The slots 16 are spaced equidistantly apart and are parallel to one another. The slots 16 may be etched in the coating 14 using conventional techniques. The width dimension of each slot may be approximately 100 mils, although other widths are possible.

A conventional hybrid electrical circuit (not shown) is connected with microstrip feed lines which are identified by numeral 18. Each of the slots 16 is provided with one of the feed lines 18. The lower end portion of each feed line 18 connects with the hybrid circuit and the lower portions of the feed lines 18 extend upwardly slightly above the lower ends of the corresponding slots 16. Each feed line 18 includes a relatively short transverse portion 18*a* which extends across the corresponding slot 16 at a right angle to the longitudinal axis of the slot. Each of the transverse portions 18*a* extends from the upper end of the leg of the feed line 18 which connects with the hybrid electrical circuit.

Each feed line 18 also includes a longitudinal portion 18*b* which extends generally upwardly from the transverse portion. Each longitudinal portion 18*b* extends along and parallel to the corresponding slot 16. The longitudinal portion 18*b* of each feed line 18 terminates in an end 18*c* which is an open circuit providing the feed point. The end 18*c* is spaced from the transverse portion 18*a* of the same feed line by a distance L which defines the length of the transverse portion 18*b*. The distance L is equal to approximately ¼λ., where λ is the wavelength of the GPS signals which the antenna is to receive.

The arrangement of the feed lines 18 relative to the slots 16 results in balanced current flowing on both sides of each of the radiating slots 16 so that there is only minimal effect on the impedance transformation. At the same time, the resonant hexafilar structure provides the right hand circular polarization which is necessary and increases the radiation coverage in the horizontal plane.

Figure 2:
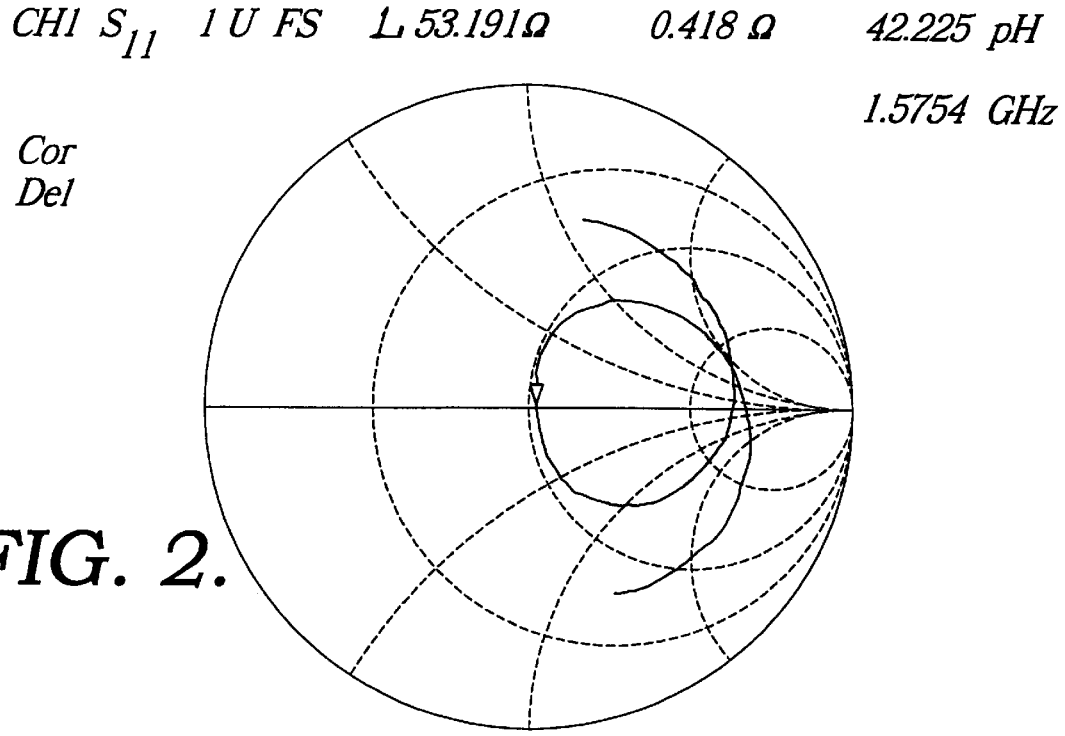
FIG. 2 is a diagrammatic view showing the measured frequency response of the input impedance of the hexafilar slot antenna of the present invention.

FIG. 2 provides the measured frequency response of the input impedance for the antenna 10. The antenna is resonant at 1.5754 Ghz with input impedance of 53+j0.5Ω. The return loss at the center frequency is greater than 25 dB.

Figure 3:
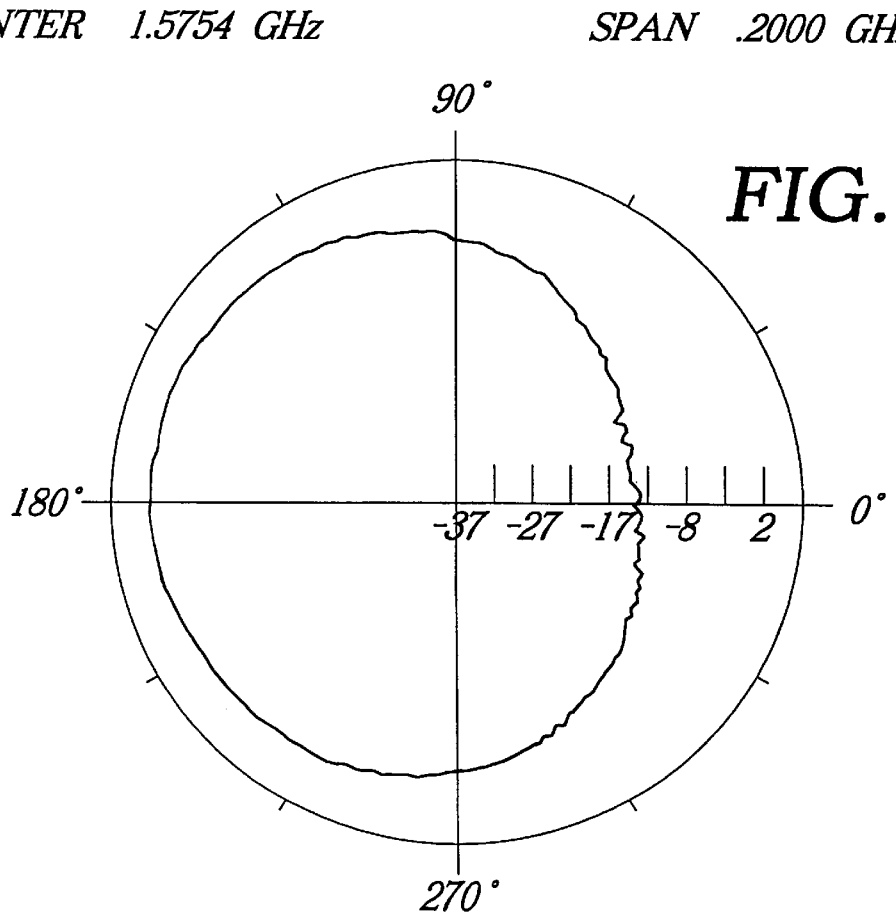
FIG. 3 is a diagrammatic view showing the radiation pattern of the hexafilar slot antenna of the present invention.

The radiation pattern of the antenna 10 is depicted in FIG. 3. The half power beam width is more than 120° and the front/back ratio is greater than 15 dB. This is generally considered to be a favorable ratio for the resistance of multipath signals from the ground.

The quarter wavelength hexafilar slot antenna 10 was verified by conducting a field test using a Garmin GPS 90™ receiver. The test was conducted under a satellite geometry with Position Dilution of Precision (PDOP) of 78 ft. The results of the test indicate that satellites 2, 4, 7, and 9 located within the axis angle of θ=±45° have calibrated signal scales of 9, 9, 9 and 10, corresponding to receiver phase noise 51 dB, 51 dB, 51 dB, and 53 dB, respectively. Satellites 14, 16, 24, and 27 located outside the axis angle of θ=±45° have calibrated signal scales of 7, 6, 6 and 5, corresponding to receiver phase noise of 47 dB, 45 dB, 45 dB and 43 dB respectively. These test results indicate a radiation pattern coverage of the antenna 10 that permits it to track satellites near the horizon at very low elevation angles.

The construction of the antenna 10 and the pattern and relationship of the slots 16 and feed lines 18 result in good input impedance matching, a good front/back ratio, and a radiation pattern coverage that is nearly hemispherical. At the same time, the known advantages of cylindrical slot antennas are achieved, including low cost manufacturing, light weight, a compact size, ease of fabrication and assembly, and simple feeding and matching techniques. The antenna 10 is particularly useful in an installation in a high-speed aircraft which requires a low profile antenna and the absence of a need to structurally modify the aircraft.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An antenna for electromagnetic signals, comprising:

a nonconductive cylindrical body;

a conductive coating substantially covering said cylindrical body;

six curved slots formed in said coating each extending partially around said cylindrical body in a helical shape, said slots being spaced apart and extending substantially parallel to one another; and a microstrip feed line for each slot, each feed line having a transverse portion extending across the corresponding slot and a longitudinal portion connected with the transverse portion thereof and extending generally along and parallel to the corresponding slot.

2. An antenna as set forth in claim 1, wherein said cylindrical body comprises a laminate.

3. An antenna as set forth in claim 1, wherein said coating provides an electrical ground for said feed lines.

4. An antenna as set forth in claim 3, wherein said longitudinal portion of each feed line terminates in an open circuit.

5. An antenna as set forth in claim 1, wherein said longitudinal portion of each feed line terminates in an open circuit.

6. An antenna as set forth in claim 1, wherein said longitudinal portion of each feed line has an end and a length L between the transverse portion thereof and said end thereof, said length L being approximately ¼ λ where λ is the wavelength of selected signals to be received by the antenna.

7. An antenna as set forth in claim 6, wherein the end of the longitudinal portion of each feed line terminates in an open circuit.

8. An antenna as set forth in claim 1, wherein each slot extends around said cylindrical body approximately one half of the circumference thereof.

9. An antenna as set forth in claim 1, wherein the transverse portion of each feed line is oriented substantially perpendicular to the corresponding slot.

10. In an airborne antenna for receiving electromagnetic satellite signals, the improvement comprising:

an antenna body constructed of a dielectric material and having the shape of a hollow cylinder presenting an outer surface, said antenna body having opposite first and second ends;

a conductive coating on said outer surface of the antenna body;

six curved slots in said coating each extending from adjacent said first end of the antenna body partially around said body in a helical shape and terminating away from said second end of the antenna body, said slots being spaced substantially equidistantly apart and extending substantially parallel to one another; and a microstrip feed line for each slot having a connection with an electric circuit, each feed line having a transverse portion extending across the corresponding slot and a longitudinal portion connected with the transverse portion thereof and extending generally along and parallel to the corresponding slot.

11. The improvement of claim 10, wherein said longitudinal portion of each feed line terminates in an end providing an open circuit.

12. The improvement of claim 11, wherein the longitudinal portion of each feed line has a length L between the transverse portion and the end thereof, said length L being approximately ¼ λ where λ is the wavelength of selected satellite signals.

13. The improvement of claim 10, wherein each slot extends around said antenna body approximately one half of the circumference thereof.

14. An antenna as set forth in claim 10, wherein the transverse portion of each feed line is oriented substantially perpendicular to the corresponding slot.

15. An antenna comprising:

A hollow cylindrical body constructed of nonconductive material, said body having opposite first and second ends and an outside surface;

a conductive coating on said outside surface of said cylindrical body;

six curved slots formed through said coating and body each extending from adjacent said first end of said cylindrical body in a helical shape and each terminating away from said second end, said slots being spaced apart and parallel;

a microstrip feed line for each slot having a connection with an electric circuit;

a transverse portion of each feed line extending across the corresponding slot substantially perpendicular thereto;

a longitudinal portion of each feed line connected with said transverse portion thereof and extending generally along and parallel to the corresponding slot; and an end of each longitudinal portion spaced from the transverse portion of the same feed line by a length L of the longitudinal portion, each length L being approximately ¼ λ where λ is the wavelength of selected electromagnetic signals to be received by the antenna.

16. An antenna as set forth in claim 15, wherein said end of each longitudinal portion of each feed line terminates in an open circuit.

17. An antenna as set forth in claim 15, wherein said coating provides an electrical ground for said feed lines.

18. An antenna as set forth in claim 15, wherein each slot extends around said cylindrical body approximately one half of the circumference thereof.

19. An antenna as set forth in claim 15, wherein said cylindrical body comprises a dielectric.

* * * * *